United States Patent [19]

Hatanaka et al.

[11] Patent Number: 4,860,211

[45] Date of Patent: Aug. 22, 1989

[54] AIR FUEL RATIO CONTROL APPARATUS

[75] Inventors: Keiji Hatanaka, Chigasaki; Kiyotoshi Sakuma, Yokohama; Kiyomi Morita, Katsuta; Junji Miyake, Mito, all of Japan

[73] Assignees: Nissan Motor Co., Ltd.; Hitachi, Ltd., both of Tokyo, Japan

[21] Appl. No.: 55,531

[22] Filed: May 29, 1987

[30] Foreign Application Priority Data

May 29, 1986 [JP] Japan ..... 61-122333

[51] Int. Cl.[4] ..... F02M 3/045

[52] U.S. Cl. ..... 364/431.05; 364/431.07; 123/325; 123/493

[58] Field of Search ..... 364/431.05, 431.07, 364/431.08, 431.06, 431.11; 123/325, 326, 493

[56] References Cited

U.S. PATENT DOCUMENTS 4,305,365 12/1981 Iizuka et al. ..... 123/325 X
4,363,097 12/1982 Amano et al. ..... 364/431.11
4,644,923 2/1987 Morita et al. ..... 123/325

*Primary Examiner*—Eugene R. LaRoche
*Assistant Examiner*—Seung Ham
*Attorney, Agent, or Firm*—Antonelli, Terry & Wands

[57] ABSTRACT

An air fuel ratio control apparatus, performs fuel decrease compensation during deceleration with respect to an air fuel ratio upon detection of a returning operation of a throttle valve. To avoid variations in torque which detract from a smooth ride, fuel decrease compensation is prohibited under the conditions that the opening of the throttle valve is in a full opening region and the amount of return movement of the throttle valve per unit time is equal to or less than a preset valve.

10 Claims, 3 Drawing Sheets

AIR FUEL RATIO CONTROL APPARATUS

BACKGROUND OF THE INVENTION

This invention relates to a fuel supply control apparatus for an internal combustion engine and, more particularly, to an air fuel ratio control apparatus suitable for use with an automobile gasoline engine.

As a system for supplying fuel to the combustion chambers of a gasoline engine, a fuel supply system using a carburetor has heretofore been employed. This system which employs a carburetor utilizes a negative pressure of suction of the engine. It is therefore difficult to perform control to obtain an accurate air fuel ratio (A/F) for all the operational conditions of the engine. For this reason, there has been widely utilized a fuel supply system in which the fuel is fed into the combustion chamber of the engine by injecting fuel through a suction pipe with the aid of a fuel injection valve which is electronically controlled.

An example of such an electronic engine control system is disclosed in U.S. Pat. No. 4,363,097. The system comprises a microcomputer, a peripheral control circuit which is connected to receive various data, such as air flow rate, temperature of engine cooling water, air fuel ratio, r.p.m. of the engine, etc. Control signals obtained on the basis of this data are supplied to a fuel injection pump, a bypass valve, exhaust gas recirculation (EGR) control valve, and a fuel to effect fuel supply amount control by controlling the fuel injection valve, idling r.p.m. control by controlling the bypass valve, and control EGR by controlling the EGR valve.

There is also provided a throttle sensor mounted on a throttle valve for detecting throttle valve opening. The opening data for the throttle valve obtained through the sensor is fetched by the microcomputer.

The control system calculates, by use of the microcomputer, fuel supply amount per unit time, based on the data of the air fuel ratio and the r.p.m. of the engine. The fuel injection value is constructed so as to provide a fixed in fuel amount per unit time, so that the injection fuel amount being supplied to the cylinder is a function of fuel injection time. Therefore, the fuel injection amount is determined by the fuel injection time, with compensation being made therefor by various factors.

Among the various kinds of compensation required for controlling the engine, a conventional electronic fuel injection system provides a so-called fuel increase compensation during acceleration and fuel decrease compensation during deceleration. Such compensation is effective according to operational conditions of the throttle valve. Namely, when the throttle valve is operated for acceleration, the fuel injection amount is compensated to be excessively rich, while it is compensated to be excessively lean when the throttle valve is operated for deceleration, whereby a desired engine performance can be achieved. However, such an engine control system employing conventional fuel compensation for acceleration and deceleration has a defect in that an abrupt change in engine torque is apt to occur during acceleration and such a torque change detracts from the type of comfortable smooth ride desired from the automobile.

SUMMARY OF THE INVENTION

An object of the invention is to provide an air fuel ratio control apparatus which is free from the above-mentioned defect and is capable of obtaining smooth acceleration under any conditions of accelerating operation intended by the driver, whereby comfortable smooth ride in the automobile can be maintained.

To accomplish this object, there is provided an air fuel ratio control apparatus according to the present invention in which fuel decrease compensation during deceleration is inhibited under certain conditions on detecting a returning operation of the throttle valve. More particulary, the invention is characterized in that the fuel decrease compensation during deceleration in which a decreased amount of fuel required by the deceleration is inhibited when certain conditions are established even though the fuel decrease compensation seems to be called for.

Generally, the throttle valve of an automobile is operated by depressing the accelerator pedal.

By examining variations in opening of the throttle valve when the driver depresses the accelerator pedal, we have confirmed that the driver in general has the tendency of pumping the accelerator pedal for achieving acceleration, so that, in fact, the throttle valve is operated a little in a returning or closing direction temporarily when the opening of the throttle valve falls in a region near full opening. As a result, in the above-mentioned prior art, a fuel decrease compensation appears briefly in the midst of fuel increase compensation during acceleration because the throttle valve is briefly moved deceleration direction in that region, and the fluctuations in torque are thereby produced. This brings about an uncomfortable feeling and detracts from the smooth ride of the vehicle.

As mentioned above, the apparatus according to the invention is based on the foregoing recognition and operates to solve this problem by inhibiting the fuel decrease compensation in such a higher throttle opening region.

The above and other objects, features and advantages of the invention will be apparent from the following description taken with reference to the drawings.

DETAILED DESCRIPTION OF THE INVENTION

Figure 1:
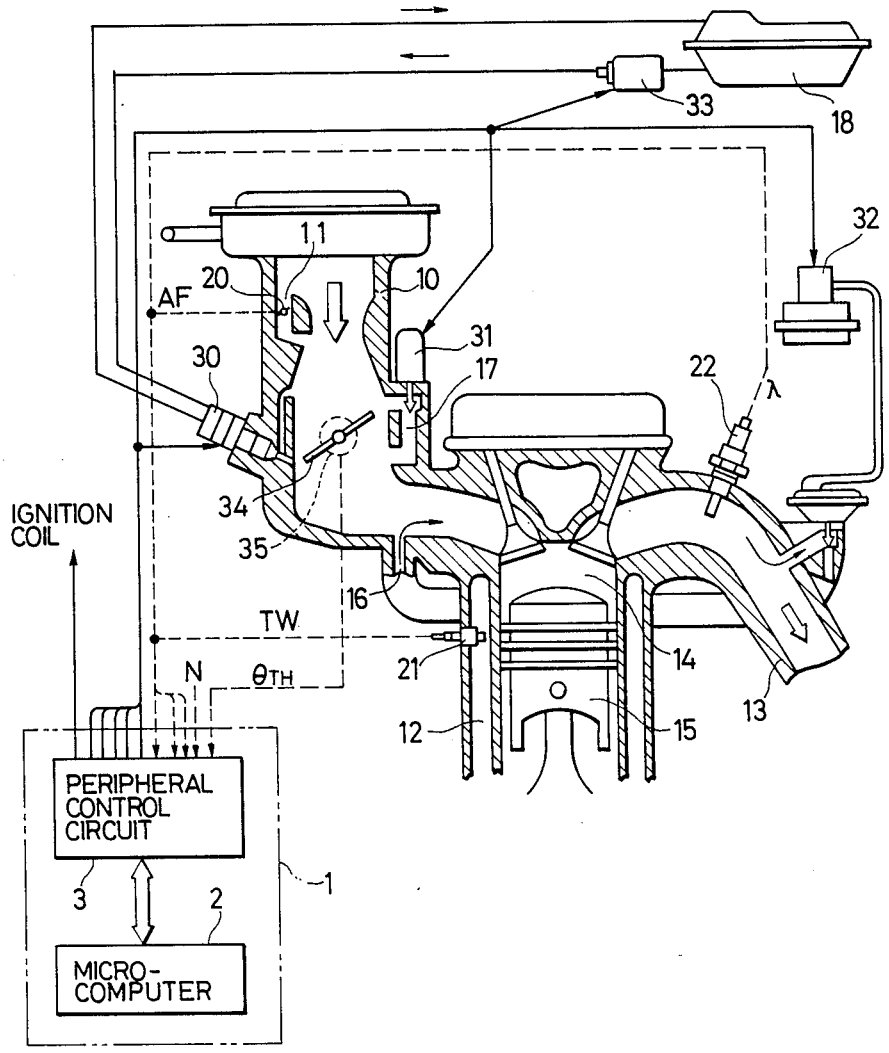
FIG. 1 is a schematic diagram showing an example of an engine control system to which an embodiment of the invention is applied.

The invention will be described hereunder in detail, referring to the drawings. Referring to FIG. 1 which shows a partial sectional view of a fuel injection system for an internal combustion engine together with an electronic control unit, the engine sucks air according to the reciprocating movement of piston 15. The air is introduced into a combustion chamber 14 of the engine through a suction pipe 10. The combustion gas produced in the combustion chamber 14 is exhausted through an exhaust pipe 13.

Fuel stored in a fuel tank 18 is supplied to a fuel injection valve 30 by a fuel pump 33 to inject fuel into the suction pipe 10 in the vicinity of the outlet of the fuel injection valve 30. The throttle valve 34 is mechanically connected to an accelerator pedal (not shown) which is operated by the driver. There is provided a bypass 17 bypassing a portion of an intake passage defined by the suction pipe 10 in which the throttle valve 34 is disposed. In the bypass 17, a bypass valve 31 is provided for controlling air flow in the bypass 17. Further, there is provided an exhaust gas recirculation (EGR) passage 16 for introducing the exhaust gas from the exhaust pipe 13 in to the intake passage, and an EGR valve 32 is mounted thereon for controlling the exhaust gas passing through the EGR passage 16. The fuel injection system is provided with various sensors which are described later.

The electronic control system 1 comprises a microcomputer 2 and a peripheral control circuit 3. The system fetches various data, that is, data AF on an air flow rate which is transmitted from an air flow rate sensor in the form of a hot wire 20 provided in a bypass 11 in the suction pipe 10, data TW on temperature which is obtained from a water temperature sensor 21 provided in an engine cooling water passage 12, data on an air fuel ratio which is sent from an air fuel ratio sensor 22 provided in the exhaust pipe 13, and data N on the number of rotations of the engine which is obtained from a rotational number sensor not illustrated. Control signals computed on the basis of this data are supplied to the fuel injection valve 30, the bypass valve 31, the EGR control valve 32, the fuel pump 33 and an ignition coil (not shown). Then, an amount of the fuel is to be supplied controlled by the fuel injection valve 30, the number of idle rotations is controlled by the bypass valve 31, and the EGR is controlled by the EGR control valve 32. In addition, the ignition is controlled by the intermittent of the ignition coil in the conventional way. On the other hand, the fuel pump 33 is controlled in such a way that the pump works only when a key switch of the engine is in its starting position or the engine goes on rotating by itself.

The throttle valve 34 is provided with a throttle sensor or an angular sensor 35 whereby data ⊖the on the degree to which the throttle valve is open is supplied to the microcomputer 2.

The microcomputer 2 of the control unit 1 processes the data AF sent from the air flow sensor 20 and computes a sucked air flow rate Qa per unit time. A fuel supply amount Fi per unit time is given by the following equation in connection with the sucked air flow rate Qa and the data N on the number of rotations of the engine:

$$Fi = Qa/N + K \quad (1)$$

wherein K is based on a variety of compensation coefficients determined by temperature, etc. of the engine.

The fuel injection amount per unit time of the fuel injection valve 30 is predetermined. In the system, a fuel injection cycle which is synchronized with rotation of the engine is preset, and the fuel is injected for a given period of time at every injection cycle, so that the supply operation is intermittently controlled. Hence, the fuel supply amount Fi in the equation (1) can be determined by an injecting time ti per stroke of the fuel injection valve 30. The equation (1) can therefore be expressed as:

$$Ti + Ki \cdot Fi = Ki \cdot Qa/N + K \quad (2)$$

wherein Ki is the coefficient determined by the fuel injection valve 30.

The control unit 1 performs the arithmetic operations at a given cycle, for instance, 10 mS, according to the equation (2) or for every preset rotation in synchronization with the rotation of the engine,thus consecutively obtaining an updated injection time Ti. The fuel injection valve 30 is driven to open according to the injection time Ti, whereby the control operation is carried out to obtain a predetermined air fuel ratio. In the above description, the compensation coefficient is represented by K. In fact, however, a wide variety of compensation coefficients are needed according to the operational conditions of the engine. Consequently, the coefficient K actually includes various factors and is expressed as K+(K1·K2·K3 . . . Kn).

In practice, an amount Tp obtained by removing the compensation coefficient K from the equation (2) is set, and this value is defined as a basic injection amount.

$$Tp + Ki \cdot Qa/N \quad (3)$$

Various compensations are given to the basic injection amount Tp for practical use in the control operation. This is a widely generalized method.

The compensation required for the conventional electronic fuel injection system is classified into fuel increase compensation during acceleration and fuel decrease compensation during deceleration.

The two types of compensation are performed, depending on the operational conditions of the throttle valve 34 of the engine. To be specific, when the throttle valve 34 is operated for acceleration, the air fuel ratio is compensated on the rich side (thicker side); and when the throttle valve 34 is operated for deceleration, the ratio is compensated on the lean side (thinner side). Owing to this process, the desired performance of the engine can be obtained. For this reason, the compensation is made on the basis of valve operating data $\theta$the given by the throttle sensor 35.

The invention is to a novel control in which the fuel decrease compensation normally employed during deceleration is inhibited in a specific region of throttle valve operation.

The phenomenon that the operation of the throttle valve for acceleration by the driver is often accompanied by a slight return movement of the throttle valve 34 as mentioned above will be described with reference to FIG. 2.

Figure 2:
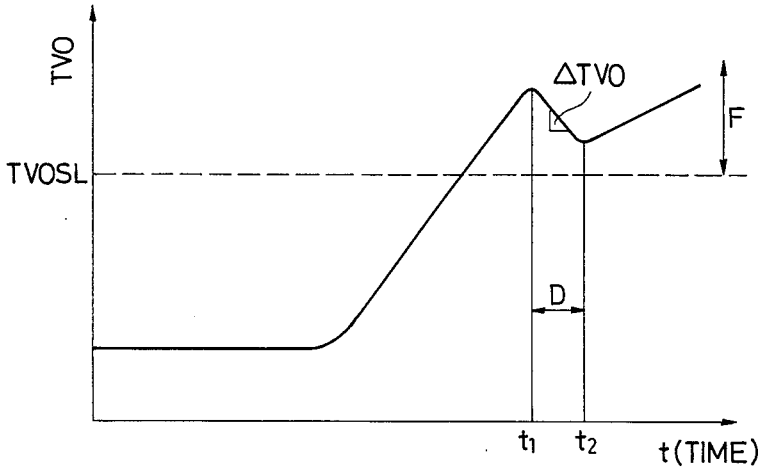
FIG. 2 is a characteristic diagram showing relationship between time and throttle valve sensor output voltage corresponding to throttle valve opening.

The opening of the throttle valve is detected as a throttle valve sensor output voltage TVO by the throttle sensor 35. In FIG. 2, the TVO is plotted along the ordinate while the lapsed time is shown along the abscissa. When the throttle valve 34 is operated for acceleration by the driver and the opening is in the region F above TVOSL which corresponds to more than $\frac{3}{4}$ of full load, generally, the throttle valve opening is apt to be slightly returned in the closed direction thereby initating deceleration of the engine and then is opened again. This deceleration movement produced during acceleration causes uncomfortable in feeling in the automobile.

The invention provides in the program of the engine control apparatus having the conventional fuel decrease compensation a special routine for causing the fuel decrease compensation to be inhibited in the region D.

Referring to the flow chart of FIG. 3 an embodiment of the invention will be described hereunder.

Figure 3:
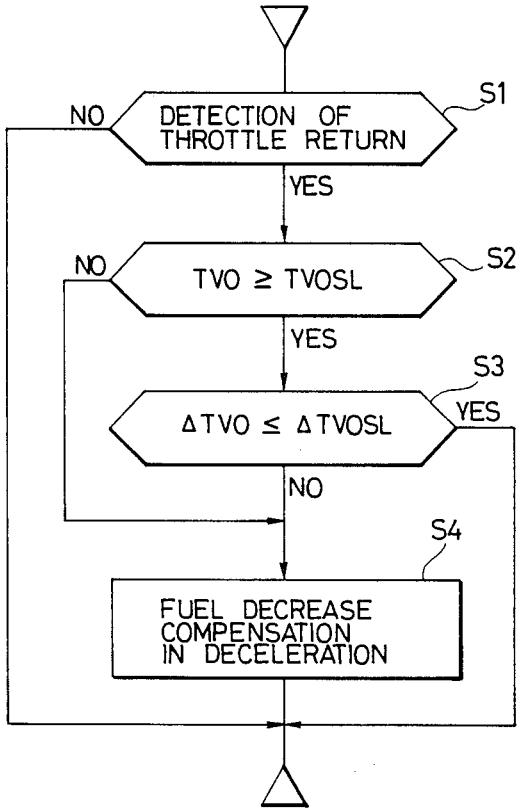
FIG. 3 is a flow chart showing the operations of an embodiment of an air fuel ratio control apparatus.

In FIG. 3, process in conformity with this flow chart is executed at predetermined cycles necessary for performing the fuel decrease compensation during deceleration.

The execution of the processes begins with an examination of the data θthe obtained by the throttle sensor 35 in step S1. Whether the throttle valve 34 is operated in the returning direction or not is judged by detecting the change in the voltage TVO.

Next, a valve of the voltage TVO of the throttle sensor 35 is examined, and whether the examined value exceeds a preset level TVOSL or not is judged in step S2. The level TVOSL is a reference level to determine whether or not the opening of the throttle valve 34 falls within the full opening region F, as shown in FIG. 2. After detecting a decreasing voltage change Δ TVO per unit time of the voltage TVO, the task in step S3 is to decide whether or not the rate of change of the examined value TVO is equal to or less than preset value Δ TVOSL.

The ordinary fuel decrease compensation during deceleration is performed so as to make the air fuel ratio lean in step S4.

In a case where the throttle valve returning movement does not appear at the time of acceleration the accelerator pedal as in the situation before a time t1 and after a time t2 in FIG. 2, the results obtained in step S1 become invariably NO, therefore, the fuel decrease compensation during deceleration is not employed at this time.

However in the region D from the time t1 to the time t2 in FIG. 2, when the throttle valve 34 is operated in such a direction that the extent of depression of the accelerator pedal is reduced, the result of the determination in the S1 step will become YES. Then, the program moves to the step S2. If the results in the step S2 are NO, the program proceeds to process step S4 where the fuel decrease compensation is employed. The fact that the results in step S2 become NO means that the voltage TVO is less than the preset value TVSOL in FIG. 2. Namely, it represents a state wherein the extent of depression of the accelerator pedal is small and the opening of the throttle valve 34 does not reach the full opening region F. In such a case, the fuel decrease compensation is unconditionally performed, and the air fuel ratio is controlled so as to be lean.

On the other hand, when detecting a decrease in opening of the throttle valve 34 within the full opening region F of FIG. 3, the results in step S2 are to YES. In this case, the program subsequently moves to step S3. If the results in step S3 become NO, this means that the velocity at which the opening of the throttle valve 34 in the region D of FIG.2 decreases exceeds a preset value, thereby proceeding to the process in step S4. Then, the fuel decrease compensation is effected, whereby the air fuel ration is so as to be lean.

When the results in step S3 become YES, however, this indicates that the velocity at which the opening of the throttle valve 34 is decreased is equal to or less than the preset value ΔTVOSL. Therefore, the program skips over to the process step S4, and the fuel decrease operation is thereby effectively by-passed.

According to this embodiment, when the accelerator pedal is released in the state where the throttle full opening region F of FIG. 2 is not reached, and when the velocity at which the accelerator pedal is released exceeds the preset value within the full opening region F, the fuel decrease compensation is employed. However, the fuel decrease compensation is neglected if the returning speed of the throttle valve is relatively low and the throttle full opening region has been reached. The speed is such that the throttle valve is operated from closing to the full opening.

As explained earlier, the uncomfortable in feeling of the driving, which is inherent in the prior art, is caused by fluctuations in torque. This kind of discomfort is attributed to the fact that a return movement actually appears in the movement of the accelerator pedal in spite of the driver's operation of the pedal with the intention of acceleration. It is because the accelerator pedal is depressed more intensively than a level that such returning is present in the movement of the accelerator pedal. To the extent that the return movement occurs unintentionally, the velocity of the return movement is probably not so high.

According to the above-described embodiment of the invention, the fuel decrease compensation is not effected as a result of the judgement made in steps S2 and S3 of FIG. 3, even when the return movement appears in the movement of the accelerator pedal within the region where the accelerator pedal is depressed more intensively than the specified level in FIG. 2, i.e., within the full opening region F which is beyond the level TVOSL in such a case that ΔTVO exhibiting the return movement velocity of the accelerator pedal is not so large. With this arrangement, it is feasible to carry out such a controlling operation that the fuel decrease compensation is neglected, corresponding to the occurrence of the unintentional return movement during the aforementioned accelerating operation. It is further possible to restrain unexpected fluctuations in torque and to entirely eliminate the uncomfortable feeling of the driving.

Figure 4:
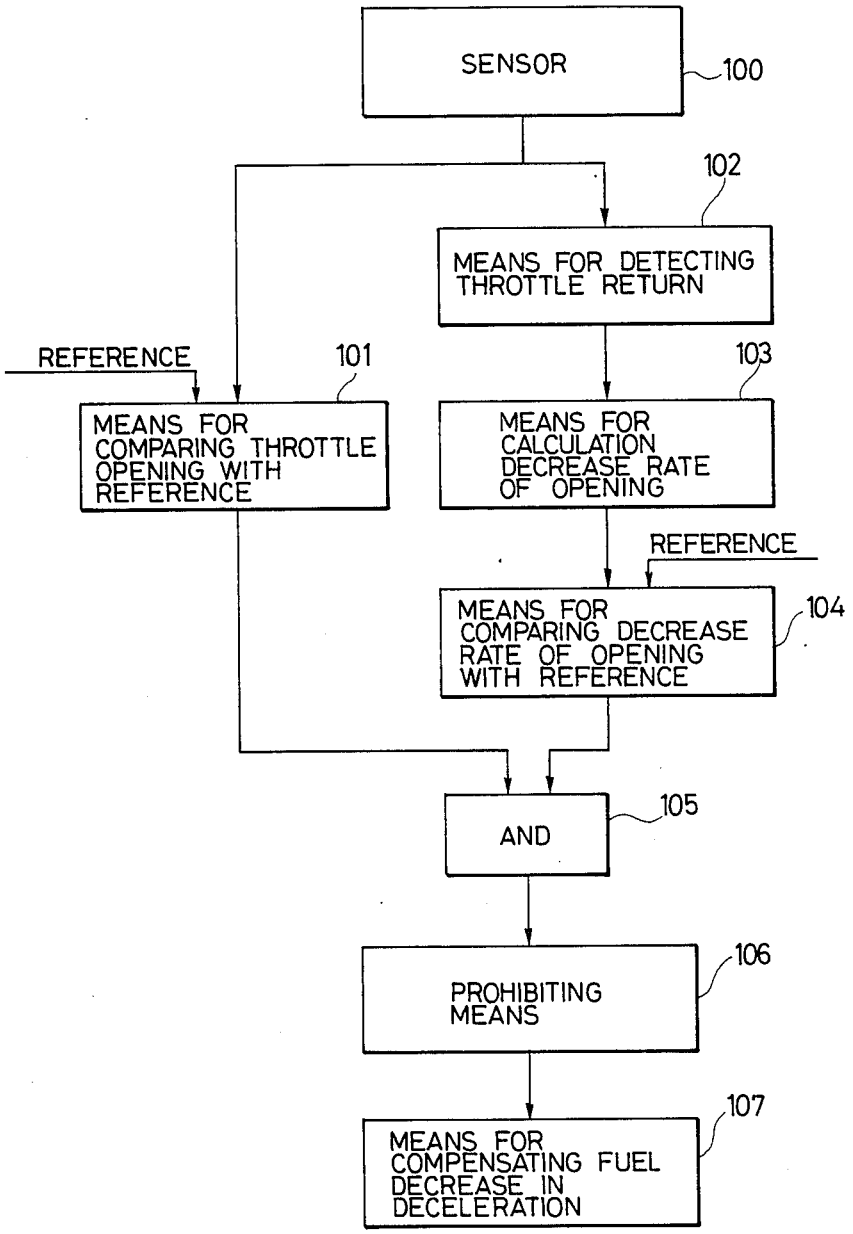
FIG. 4 is a block diagram showing an example of an function of the invention.

FIG. 4 shows an example of a functional expression of the invention. In FIG. 4, means 100 for detecting a throttle valve opening such as the angular sensor 35 detects the opening of the throttle valve 34 and outputs a signal in proportion to the opening of the throttle valve 34. Means 101 is for comparing the opening signal from the means 100 with a preset value TVOSL as a reference and generates a signal when the opening signal exceeds the preset value. Means 102 is for detecting return movement of the throttle valve 34 through examination of the opening signal and sends or passes the opening signal when the opening signal is decreasing in value. Means 103 is for calculating the decrease rate Δ TVO of the value of the opening signal sent by the means 102 and transmits a signal representing the calculation result. Means 104 is for comparing the decrease rate of the opening signal with a preset value as a reference and generates a signal when the decrease rate of the opening signal or throttle valve returning speed is less than the preset value. AND gate 105 sends a signal to means 106 for prohibiting fuel decrease compensation mentioned above when the signals from the means 101 and 104 are sent thereto. Means 107 for compensating fuel decrease is inhibited from performing its fuel decrease compensation. This is affected in the computer program.

According to the invention, the fluctuation in torque otherwise caused during the acceleration can be considerably restrained.

We claim:

1. In an air fuel ratio control apparatus for internal combustion engines, wherein fuel decrease compensation is effected during deceleration with respect to an air fuel ratio based on a detected returning movement of a throttle valve, the improvement comprising:

means for inhibiting said fuel decrease compensation on the condition that opening of said throttle valve is at least equal to a predetermined opening value and an amount of returning movement of said throttle valve per unit time is no more than a predetermined velocity value.

2. The air fuel ratio control apparatus according to claim 1, including a throttle sensor producing an output voltage representing throttle opening, and wherein said predetermined opening value is a throttle sensor output voltage corresponding to a region adjacent to full opening of said throttle valve.

3. The air fuel ratio control apparatus according to claim 2, wherein said predetermined opening value is a value corresponding to $\frac{3}{4}$ of full load of the engine.

4. An air fuel ration control apparatus for an internal combustion engine, including means for compensating air fuel ratio by effecting a decrease in fuel during deceleration, which apparatus comprises:

first means for detecting degree of opening of a throttle valve and for outputting an opening signal proportional to the opening angle of said throttle valve;

second means for comparing the opening signal with a first preset value and generating a first signal when said opening signal exceed said first preset value;

third means for detecting a returning movement of said throttle valve from said opening signal and for transmitting the opening signal when the returning movement is detected;

fourth means for calculating a rate of decrease of the value of the opening signal from said third means and for outputting a resultant signal;

fifth means for comparing the resultant signal from said fourth means with a second preset value and for outputting a second signal when the value of the resultant signal is less than said second preset value; and sixth means for inhibiting said means for compensating fuel decrease in response to receipt of both of said first and second signals.

5. The air fuel ratio control apparatus according to claim 4, wherein said first preset value corresponds to a level over which the throttle valve opening is in a full opening region, and said second preset value corresponds to a rate of throttle valve closing over which practice of fuel decrease compensation is allowed.

6. In an air fuel ratio control apparatus for internal combustion engines, wherein fuel decrease compensation is effected through control of air fuel ratio so as to reduce an amount of fuel injected into the engine thereby to attain a desired air fuel ratio when a partial closing operation of a throttle valve is detected by a sensor, the improvement comprising:

means for prohibiting said fuel decrease compensation on the condition that the detected opening of said throttle valve is a predetermined value or more and an amount of closure of said throttle valve per unit time, based on the detected opening of said throttle valve, is a predetermined value or less.

7. The air fuel ratio control apparatus according to claim 6, wherein the opening of said throttle value is detected as a throttle sensor output voltage of said sensor, and said predetermined opening value is a throttle sensor output voltage corresponding to a full opening region of said throttle valve.

8. The air fuel ratio control apparatus according to claim 7, wherein said predetermined opening value is a value corresponding to $\frac{3}{4}$ of full load of the engine.

9. An air fuel ratio control apparatus for internal combustion engines, comprising:

means for compensating fuel during deceleration by controlling an air fuel ratio so as to reduce an amount of fuel injected into the engine thereby to attain a desired air fuel ratio when a throttle valve is operated in a closing direction;

means for detecting opening of said throttle valve and for outputting an opening signal proportional to the degree of opening of said throttle valve;

means for comparing the level of said opening signal with a first preset value corresponding to a preset opening of said throttle valve and for generating a first signal when said opening signal exceeds said first preset value;

means for detecting a closing operation of said throttle valve from said opening signal;

means for calculating a decreasing rate of a throttle valve opening through calculation of the value of the opening signal from said means for detecting throttle valve opening operation and for outputting a resultant signal;

means for comparing the resultant signal from said calculating means with a second preset value of a decreasing of throttle valve opening and for outputting a second signal when the value of the resultant signal is less than said second preset value of decreasing rate of throttle valve opening; and means for inhibiting said means for compensating fuel upon receipt of both of said first and second signals.

10. The air fuel ratio control apparatus according to claim 9, wherein said first preset value corresponds to a level over which the throttle valve opening is in a full opening region, and said second preset value corresponds to a rate of throttle valve closing over which practice of fuel decrease compensation is allowed.

* * * * *